US012405072B2

(12) United States Patent
Tago et al.

(10) Patent No.: US 12,405,072 B2
(45) **Date of Patent: *Sep. 2, 2025**

(54) HEAT EXCHANGER MEMBER, HEAT EXCHANGER, AIR CONDITIONER INDOOR UNIT, AIR CONDITIONER OUTDOOR UNIT, AND REFRIGERATOR

(71) Applicant: YAMAICHI SPECIAL STEEL CO., LTD., Nagoya (JP)

(72) Inventors: Emi Tago, Nagoya (JP); Hideharu Tajima, Nagoya (JP)

(73) Assignee: YAMAICHI SPECIAL STEEL CO., LTD, Nagoya (JP)

( * ) Notice: Subject to any disclaimer, the term of this patent is extended or adjusted under 35 U.S.C. 154(b) by 9 days.

This patent is subject to a terminal disclaimer.

(21) Appl. No.: 18/549,254

(22) PCT Filed: Mar. 9, 2022

(86) PCT No.: PCT/JP2022/010343

§ 371 (c)(1),
(2) Date: Sep. 6, 2023

(87) PCT Pub. No.: WO2022/196497

PCT Pub. Date: Sep. 22, 2022

(65) Prior Publication Data

US 2024/0159480 A1 May 16, 2024

(30) Foreign Application Priority Data

Mar. 16, 2021 (JP) ..... 2021-042273

(51) Int. Cl.
*F28F 13/18* (2006.01)
*F24F 1/0059* (2019.01)

(52) U.S. Cl.
CPC ..... *F28F 13/187* (2013.01); *F24F 1/0059* (2013.01); *F28F 2245/02* (2013.01)

(58) Field of Classification Search
CPC ..... F24F 1/0059; F28F 13/18; F28F 13/187; F28F 19/00; F28F 19/02; F28F 2245/02; F28F 21/084; F28F 21/089
See application file for complete search history.

(56) References Cited

U.S. PATENT DOCUMENTS 5,693,236 A 12/1997 Okumura et al.
6,156,409 A 12/2000 Doushita et al.
(Continued)

FOREIGN PATENT DOCUMENTS

CN 102732752 A 10/2012
CN 208419712 U 1/2019
(Continued)

OTHER PUBLICATIONS

Translation of the Written Opinion of the International Searching Authority mailed Apr. 5, 2022 for International Patent Application No. PCT/JP2022/010343 (4 pages).
(Continued)

*Primary Examiner* — Eric S Ruppert
*Assistant Examiner* — Hans R Weiland
(74) *Attorney, Agent, or Firm* — Smith, Gambrell & Russell, LLP

(57) ABSTRACT

Provided is a highly efficient heat exchanger member while imparting, to a metal surface, a characteristic that the metal itself does not have with a coating film having excellent thermal conductivity.

The heat exchanger member is made of metal, and includes a carbon-containing hydrated oxide film (112B) on a surface of the metal, in which fine concave-convex portions (112C) are provided, an average distance between apexes of the convex portions of the fine concave-convex portions (112C) is 20 nm or more and 120 nm or less, an average value of differences in height between apexes of adjacent convex
(Continued)

portions and a bottom point of the concave portion is 10 nm or more and 250 nm or less, and at least a portion of a surface of the carbon-containing hydrated oxide film (112B) is a hydrated oxide.

7 Claims, 6 Drawing Sheets

(56) References Cited

U.S. PATENT DOCUMENTS

| | | | | |
|---|---|---|---|---|
| 9,635,784 | B2 | 4/2017 | Yamaguchi et al. | |
| 10,107,574 | B2 * | 10/2018 | Yamada | F24D 17/0073 |
| 10,396,009 | B2 | 8/2019 | Yamaguchi et al. | |
| 12,152,842 | B2 * | 11/2024 | Tajima | F28F 21/02 |
| 2005/0269065 | A1 | 12/2005 | Chen | |
| 2007/0028588 | A1 | 2/2007 | Varanasi et al. | |
| 2007/0031639 | A1 | 2/2007 | Hsu et al. | |
| 2013/0112379 | A1 | 5/2013 | Ko et al. | |
| 2014/0140008 | A1 | 5/2014 | Yamaguchi et al. | |
| 2017/0186664 | A1 | 6/2017 | Yamaguchi et al. | |
| 2018/0142129 | A1 * | 5/2018 | Yamamoto | C09D 201/04 |
| 2020/0025464 | A1 * | 1/2020 | Chiang | F28F 1/32 |
| 2022/0228819 | A1 | 7/2022 | Tajima et al. | |
| 2022/0260327 | A1 | 8/2022 | Tajima et al. | |

FOREIGN PATENT DOCUMENTS

| | | | | | |
|---|---|---|---|---|---|
| JP | H05-322469 | A | | 12/1993 | |
| JP | H10-26491 | A | | 1/1998 | |
| JP | 10281690 | A | * | 10/1998 | F28F 13/18 |
| JP | H10-281690 | A | | 10/1998 | |
| JP | H11-91024 | A | | 4/1999 | |
| JP | H11-100234 | A | | 4/1999 | |
| JP | 2001-248951 | A | | 9/2001 | |
| JP | 2004-190928 | A | | 7/2004 | |
| JP | 2005-207612 | A | | 8/2005 | |
| JP | 2006-242390 | A | | 9/2006 | |
| JP | 2009-228999 | A | | 10/2009 | |
| JP | 2010-034089 | A | | 2/2010 | |
| JP | 2013-092289 | A | | 5/2013 | |
| JP | 2013-103414 | A | | 5/2013 | |
| JP | 2014-029240 | A | | 2/2014 | |
| JP | 2015-169411 | A | | 9/2015 | |
| JP | 2016-061526 | A | | 4/2016 | |
| JP | 2017-015377 | A | | 1/2017 | |
| JP | 2019-151881 | A | | 9/2019 | |
| JP | 2019-167622 | A | | 10/2019 | |
| KR | 10-1603063 | B1 | | 3/2016 | |
| WO | 2013/046291 | A1 | | 4/2013 | |
| WO | 2014/064450 | A1 | | 5/2014 | |
| WO | 2021/054247 | A1 | | 3/2021 | |
| WO | 2021/187088 | A1 | | 9/2021 | |

OTHER PUBLICATIONS

International Preliminary Report on Patentability mailed Sep. 12, 2023 for International Patent Application No. PCT/JP2022/010343 (5 pages in Japanese; 5 Pages English translation).

Japanese Office Action mailed Oct. 17, 2024 for Japanese Patent Application No. 2021-042273 (4 pages in Japanese; 4 pages English translation).

International Search Report dated Apr. 5, 2022 for International Patent Application No. PCT/JP2022/010343 (3 pages in Japanese with English translation).

Written Opinion of the International Searching Authority dated Apr. 5, 2022 for International Patent Application No. PCT/JP2022/010343 (4 pages in Japanese).

Wilke. Kyle L., et al. Turning traditionally nonwetting surfaces wetting for even ultra-high surface energy liquids. PNAS. 2022. Vol. 119, No. 4, pp. 1-7.

Notice of Allowance mailed Jul. 24, 2024 for U.S. Appl. No. 17/612,303 (8 pages).

Non Final Office Action mailed Mar. 27, 2024 for U.S. Appl. No. 17/612,312 (9 pages).

Final Office Action mailed Jul. 25, 2024 for U.S. Appl. No. 17/612,312 (11 pages).

Non Final Office Action mailed Dec. 13, 2024 for U.S. Appl. No. 17/612,312 (12 pages).

* cited by examiner

HEAT EXCHANGER MEMBER, HEAT EXCHANGER, AIR CONDITIONER INDOOR UNIT, AIR CONDITIONER OUTDOOR UNIT, AND REFRIGERATOR

TECHNICAL FIELD

The present invention relates to a heat exchanger member having a metal surface provided with characteristics other than characteristics inherent to the metal, and a device including the member.

BACKGROUND ART

When an air conditioner is in operation, dew condensation and frost formation occurs on surfaces of heat exchange fins of heat exchangers provided in an indoor unit and an outdoor unit. The dew condensation and frost formation on the surface of the heat exchange fin have adverse effects such as reduction in blowing efficiency, reduction in heat exchange performance, and an accompanying increase in power consumption of the air conditioner itself. In recent years, in the field of air conditioning, a technique related to hydrophilization has been actively studied as a countermeasure against the dew condensation and the frost formation on the surface of the heat exchange fin. Such a technique is disclosed in, for example, Patent Literature 1.

Patent Literature 1 describes a method for suppressing an increase in ventilation resistance due to dew condensation occurring in a heat exchange fin, by forming a hydrophilic resin coating film including an acrylic resin (polyacrylic acid-based, acrylamine-based, acrylamide-based, etc.), a cellulose-based resin, a polyvinyl alcohol-based resin, an amide-based resin, an amino-based resin, or the like on a surface of the heat exchange fin of a heat exchanger.

CITATIONS LIST

Patent Literature

Patent Literature 1: JP-A-5-322469

SUMMARY OF INVENTION

Technical Problems

However, the technique of Patent Literature 1 uses: an organic resin such as an acrylic resin having significantly lower thermal conductivity (about 1/180 of thermal conductivity of aluminum oxide) than that of aluminum, which is a general material of a heat exchange fin of a heat exchanger, or aluminum oxide naturally formed on the surface thereof; or a ceramic material such as silica particles (about 1/20 of thermal conductivity of aluminum oxide) and zeolite (about 1/180 of thermal conductivity of aluminum oxide) which are also used for a hydrophilic coating film, are used. For this reason, there is a problem that a composition itself of the hydrophilic coating film, which is supposed to be a countermeasure against the increase in the power consumption of the air conditioner, may increase the power consumption of the air conditioner, when the air conditioner is operated in an environment where no dew condensation and the like occur.

In addition, in a hydrophilization technology in which merely a contact angle is reduced, there is also a problem that water droplets generated by actual dew condensation may remain adhering without sliding down, and finally become ventilation resistance.

The present invention has been made in view of the above problems, and an object of the present invention is to realize a heat exchanger member, a heat exchanger, an air conditioner, and a refrigerator with high efficiency, by imparting a characteristic that the metal itself does not have to a metal surface forming a heat exchanger and a heat exchange fin of the heat exchanger, with a coating film having excellent hydrophilicity and thermal conductivity.

Solutions to Problems

In order to solve the above problems, a heat exchanger member of the present invention is a heat exchanger member made of metal, and including a metal oxide film, on a surface of the metal, in which concave-convex portions are provided and crystalline carbon is contained. An average distance between apexes of the convex portions is 20 nm or more and 120 nm or less, an average value of heights of apexes of the convex portions adjacent to each other is 10 nm or more and 250 nm or less, and at least a portion of a surface of the metal oxide film is a hydrated oxide.

Advantageous Effects of Invention

The present invention has an effect that a function of improving heat exchange efficiency of a heat exchanger can be added to a heat exchanger member.

DESCRIPTION OF EMBODIMENT

Embodiment 1

Hereinafter, an embodiment of the present invention will be described with reference to FIGS. 1 to 6.

<Configuration of Indoor Unit of Air Conditioner in which Member is Incorporated>

Figure 1:
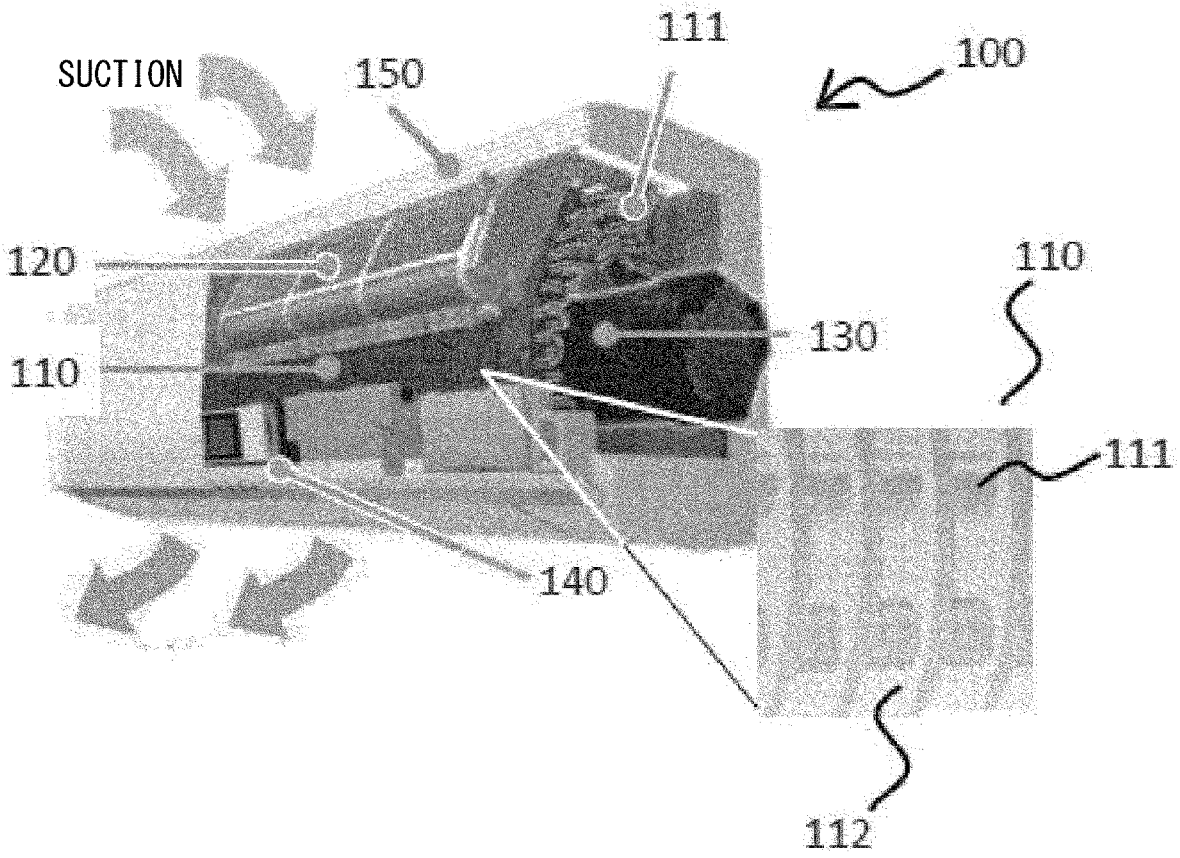
FIG. 1 is a perspective view illustrating an indoor unit of an air conditioner using a heat exchanger member according to Embodiment 1 of the present invention.

FIG. 1 is a diagram illustrating a cut model of an indoor unit 100 of an air conditioner. The indoor unit 100 of the air conditioner includes a heat exchanger 110, an air filter 120, a blower fan 130, a drain pan 140, a housing 150, a control unit, a drive unit, and the like (not illustrated).

The heat exchanger 110 is constituted of a refrigerant pipe 111 and a fin 112. The heat exchanger member of the present invention means a member constituting the heat exchanger 110 (the refrigerant pipe 111 and the fin 112). In the following description, the heat exchanger member will be described as a member constituting the fin 112.

<Configuration of Member>

Figure 2:
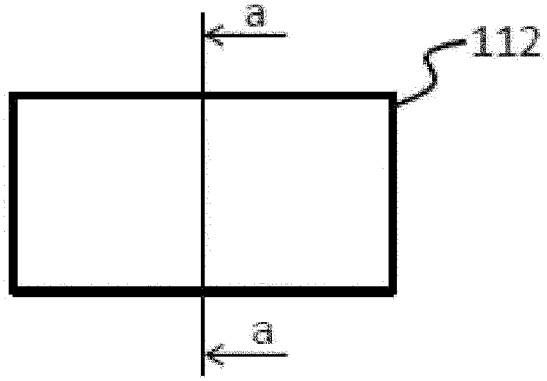
FIG. 2 is a view illustrating the heat exchanger member according to Embodiment 1 of the present invention.
Figure 3:
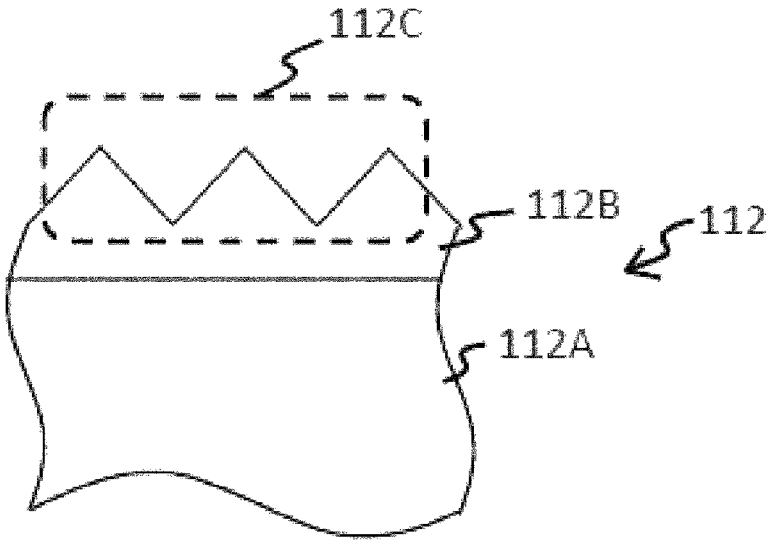
FIG. 3 is a schematic view illustrating a cross section taken along line a-a indicated by arrows in FIG. 2.

FIG. 2, and FIG. 3 which is a cross-sectional view taken along line a-a in FIG. 2, are diagrams illustrating the fin 112 constituting the heat exchanger 110 which is a specific example of the heat exchanger member of the present invention. As illustrated in FIG. 3, a carbon-containing hydrated oxide film 112B provided with fine concave-convex portions 112C is provided on a metal base 112A made of a main material (aluminum, copper, etc.) forming the fin 112. The carbon-containing hydrated oxide film 112B having the fine concave-convex portions 112C is a hydrated metal oxide film in which carbon is contained and at least a portion of which is hydrated, and provides a function of improving heat exchange efficiency of the heat exchanger 110.

The fin 112 is made of a rolled aluminum plate or a rolled copper plate. The thickness of the fin 112 may be 0.05 to 0.50. Further, the thickness of the fin 112 is preferably 0.05 to 0.20 so that, when configured as a heat exchanger, the surface area can be made wider than that of the fin 112 in a heat exchanger having the same volume. The size is appropriately determined according to the purpose of use.

The carbon-containing hydrated oxide film 112B is an oxide of the metal same as or similar to the metal base material, in which carbon is contained, and at least a portion thereof is a hydrated metal oxide. The film thickness of the carbon-containing hydrated oxide film 112B may be 40 nm to 300 nm. Further, the film thickness of the carbon-containing hydrated oxide film 112B is preferably 100 nm to 300 nm in order to utilize thermal conductivity of the contained carbons and improve corrosion resistance. A content ratio of carbon contained in the carbon-containing hydrated oxide film 112B may be 1 at % to 50 at % at a point of 3 nm to 5 nm from a surface (the surface opposite to a surface in contact with the metal base 112A). Further, the content ratio of carbon contained in the carbon-containing hydrated oxide film 112B is preferably 3 at % to 40 at % at a point of 3 nm to 5 nm from the surface in order to have characteristics imparted by containing carbon and maintain strength of a film.

The carbon contained in the carbon-containing hydrated oxide film 112B is preferably a carbon having crystallinity, and a carbon nanotube, fullerene, graphene, or the like is preferable for enhancing thermal conduction.

Although the carbon nanotube, fullerene, graphene, and the like are expensive, the carbon-containing hydrated oxide film 112B containing these materials is extremely thin as compared with a so-called coating; therefore, the amount itself actually contained is very small, and thus the carbon-containing hydrated oxide film is excellent also in terms of cost.

The fine concave-convex portions 112C are provided on the surface of the carbon-containing hydrated oxide film 112B (the surface opposite to the surface in contact with the metal base 112A), an average distance between apexes of the convex portions of the fine concave-convex portions 112C may be 20 nm or more and 120 nm or less, and an average value of differences in height between apexes of adjacent convex portions and a bottom point of the concave portion may be 10 nm or more and 250 nm or less. In addition, in the fine concave-convex portions 112C, the average value of differences in height between the apexes of the convex portions and the bottom point of the concave portion is more preferably 100 nm or more and 200 nm or less in order to impart more hydrophilicity.

Hereinafter, an example according to Embodiment 1 will be described with reference to FIGS. 5 to 6. The fin 112 in the example is produced from an aluminum plate of 60 mm×60 mm×0.5 mm. In order to provide the carbon-containing hydrated oxide film 112B having the fine concave-convex portions 112C on a surface of the aluminum plate (metal base 112A), the following treatment was performed.

First, the aluminum plate (metal base 112A) is ultrasonically washed with ethanol having a purity of 99.5% (washing time: 5 minutes). Thereafter, as illustrated in FIG. 5, the aluminum plate connected to an electric circuit 400 and electrodes 404 and 405 made of SUS 304 and connected to the electric circuit 400 are immersed in a bath 300 containing a treatment liquid 301. The treatment liquid 301 in the bath 300 is obtained by adding sodium hydroxide and a 0.2% carbon nanotube dispersion liquid to purified water so as to have concentrations of 1.7 g/l and 1.64 ml/l, respectively. The liquid temperature is room temperature (20° C. to 30° C.)

Figure 5:
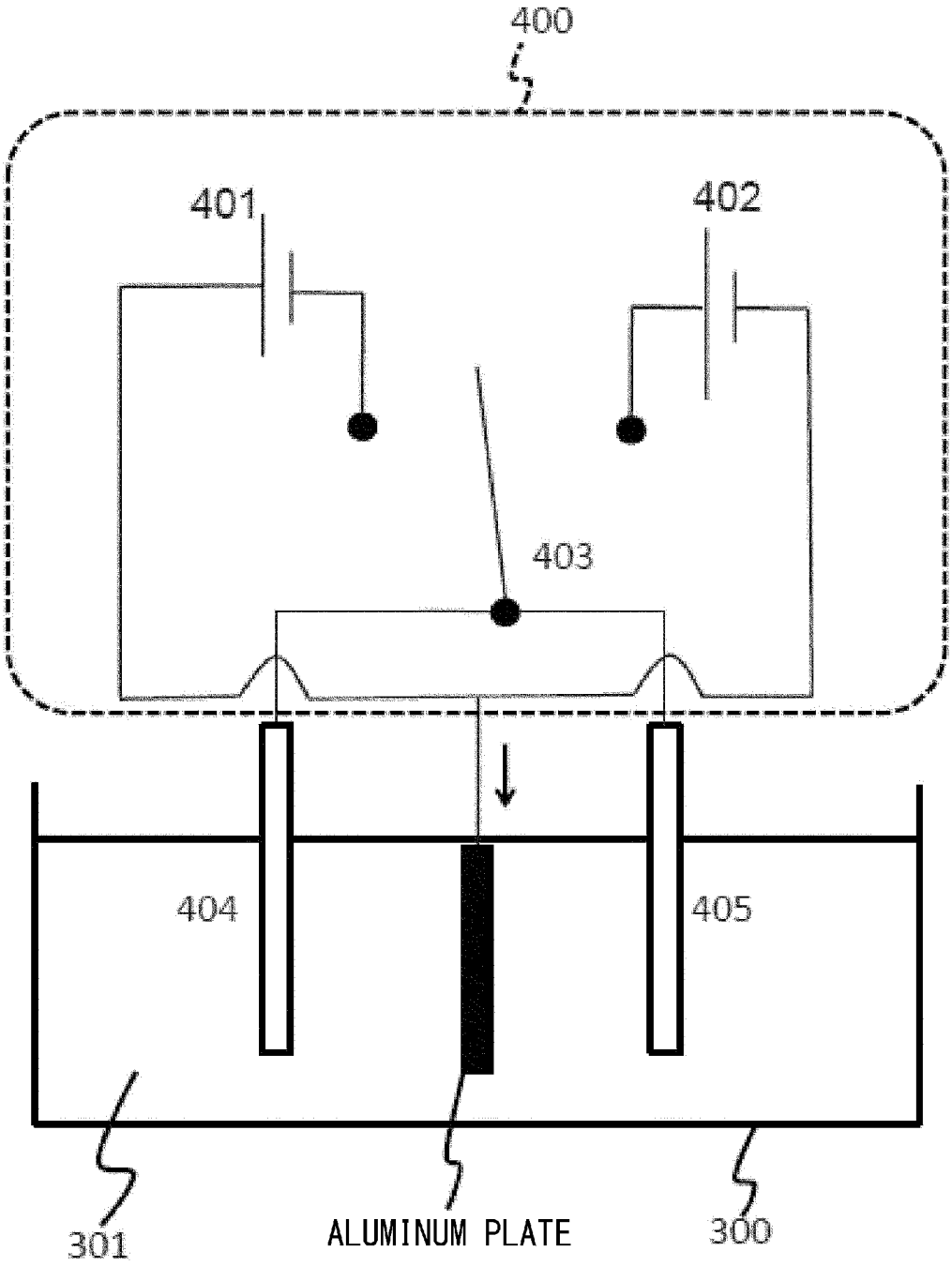
FIG. 5 is a view illustrating equipment for producing Embodiment 1 of the present invention.
Figure 6:
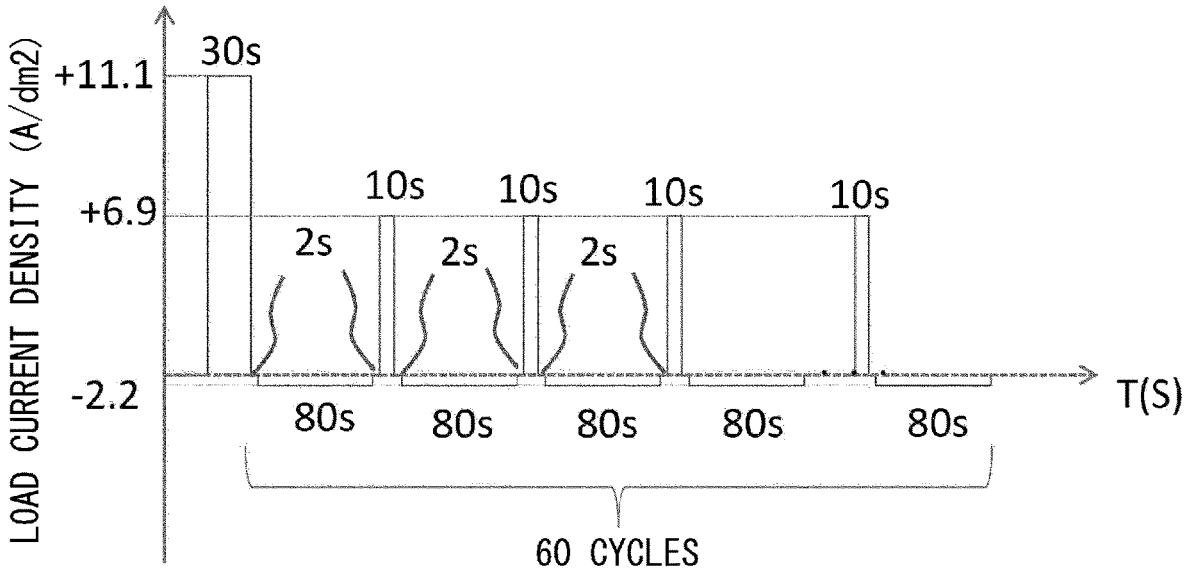
FIG. 6 is a view illustrating a time chart of a load electrolysis density for producing Embodiment 1 of the present invention.

Thereafter, with the current flowing in a direction of an arrow illustrated in FIG. 5 defined as a voltage in a + direction, voltage was loaded on an aluminum plate by a rectifier 401, a rectifier 402, and a changeover switch 403 with a pattern as illustrated in FIG. 6.

Next, ultrasonic washing (washing time: 5 minutes) is performed with purified water. In addition, an aluminum oxide on the surface of the aluminum plate is hydrated by immersion in hot water at 98° C. for 15 minutes, and finally dried by air blow. In this way, 200 nm of the carbon-containing hydrated oxide film 112B was provided on the surface of the aluminum plate (metal base 112A), and at the same time, the fine concave-convex portions 112C, in which the average distance between the apexes of the convex portions of the concave-convex shape is 75 nm and the average value of differences in height between the apexes of adjacent convex portions and the bottom point of the concave portion is 50 nm, were provided on the surface of the carbon-containing hydrated oxide film 112B, thereby obtaining the fin 112.

<Demonstration Test>

Here, characteristics required for the fins constituting the heat exchanger will be described. In the heat exchanger, a large number of fins for heat exchange are arranged with extremely narrow gaps. Thus, when the fin is used to remove heat from the outside air, dew condensation occurs on the fin surface. The dew condensation forms a bridge of water droplets between the fins in the indoor unit during cooling operation, and inhibits ventilation between the fins. As a result, the dew condensation inhibits heat conversion efficiency of heat exchange. Thus, by preventing the bridge of the water droplets between the fins due to the dew condensation, the heat exchange efficiency of the heat exchanger can be significantly improved. However, it is difficult to prevent the occurrence of the dew condensation itself, and there was no choice but to perform a hydrophilic treatment of applying a hydrophilic coat to the fin in order to prevent a bridge of dew condensation water, in which, however, a contact angle was not sufficiently lowered and the water droplet itself did not slide down, resulting in that, for example, the water droplets accumulated and eventually formed bridges. Thus, a bridge of dew condensation water could not be sufficiently prevented.

In addition, the effect of reducing the contact angle by the hydrophilic coating is not durable, and the contact angle increases as soon as dew condensation and drying are repeated, thus lacking a long-term preventing effect.

In addition, in the said hydrophilic treatment, there is provided an acrylic resin, silica particles, zeolite, or the like having lower thermal conductivity than that of aluminum oxide naturally formed on a surface of aluminum, and thus, there was also a problem that the heat exchange rate, which is all-important, decreases.

Although the mechanism is unknown, the fin 112 constituting the heat exchange of the present invention has a remarkable effect of preventing the bridge of the dew condensation water since the contact angle is reduced and also the adhering water droplet easily slides down. In addition, since there is provided the carbon-containing hydrated oxide film 112B which contains carbon having higher thermal conductivity than aluminum oxide on the surface of aluminum, the heat exchange efficiency of aluminum, which is a main material of the fin 112, is not inhibited as compared with a general hydrophilic treatment in which an acrylic resin, silica particles, zeolite, or the like having lower thermal conductivity than that of aluminum is provided.

Figure 4:
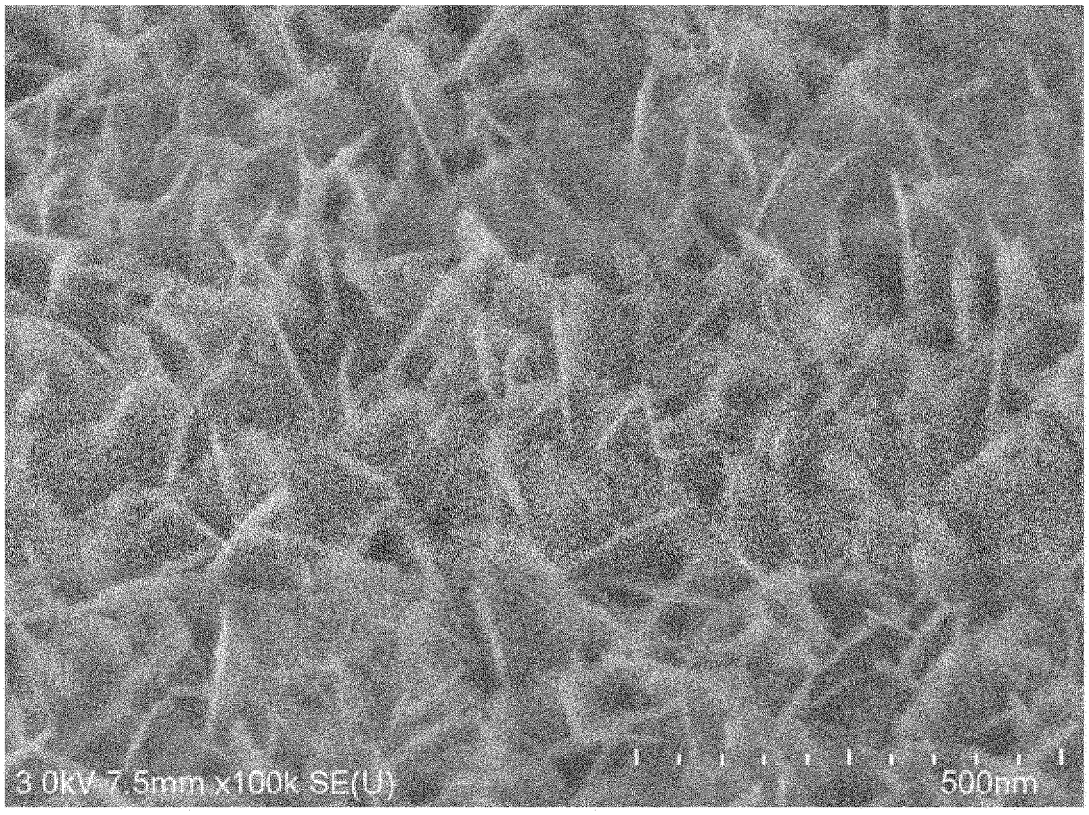
FIG. 4 is a SEM perspective view of a surface of the heat exchanger member according to Embodiment 1 of the present invention.

A contact angle with water and a sliding angle were measured in the following fins: the fin 112 constituting the heat exchanger of the present invention illustrated in FIG. 4; a comparative fin 113, for comparison and not illustrated, including an untreated aluminum plate equivalent to an aluminum plate before the treatment for forming the carbon-containing hydrated oxide film; a comparative fin 114, also not illustrated, obtained by applying only hydration treatment to an untreated aluminum plate; and a comparative fin 115, also not illustrated, obtained by applying a silica-based hydrophilic coat used in an existing air conditioner to a surface of an untreated aluminum plate. As a result, the fin 112 of the present invention had a contact angle of 17° and a sliding angle of 26°. The comparative fin 113 had a contact angle of 93°, and sliding down did not occur. The comparative fin 114 had a contact angle of 46°, and sliding down did not occur. The comparative fin 115 had a contact angle of 14°, and sliding down did not occur.

The sliding angle described above is an angle at which a water droplet starts sliding down, when the water droplet made of 10 μl of purified water is dropped on a plate to be measured placed horizontally and the plate to which the water droplet adheres is inclined at a predetermined speed. That is, the fact that the sliding-down angle is small means that the condensed water droplet more easily slides down, and the bridge of the water droplets generated between the fins is less likely to be formed as compared with a case where merely the contact angle is small.

From the above results, it was confirmed that the fin 112 of the present invention had a higher effect of preventing water droplet bridge than the comparative fins 113 to 115.

A heat exchange fin used in the air conditioner is used for a long period of time while adhesion of water droplets due to dew condensation and drying during non-operation are repeated. Thus, not only initial characteristics but also maintenance of characteristics after repeated water droplet adhesion and drying are important.

Accordingly, as an accelerated test of a cycle of water droplet adhesion and drying, there is a dry-wet test. When the drying test was performed on the fin 112 of the present invention and the comparative fin 115, increase angles of the contact angle after the test were 5° and 55°, respectively. From the above results, it was confirmed that characteristic maintainability of the fin 112 of the present invention was excellent.

A heat exchanger (not illustrated) was produced using the fin 112 of the present invention and the comparative fin 113, and installed in a hermetically sealed box capable of circulating air therein, and cooling characteristics were confirmed under low humidity (26° C., 30% RH). As a result, in the heat exchanger using the fin 112 of the present invention, the reached temperature after 2 hours was 5.6° C.; however, in the heat exchanger using the comparative fin 113, cooling was possible only up to 7.6° C. That is, although the clear reason is unknown at the present time, it can be said that the fin of the present invention is excellent in heat exchangeability regardless of dew condensation.

In the present example, a wet electrolytic treatment under the above conditions is used in order to form the carbon-containing hydrated oxide film 112B having the fine concave-convex portions 112C on the surface; however, the present invention is not limited thereto. The carbon-containing hydrated oxide film may be formed under other conditions or by other treatment methods (sputtering using a metal oxide target containing a carbon nanotube, a sol-gel method, and the like), and then may be subjected to hydration treatment. Nevertheless, the wet electrolytic treatment is superior to other treatment methods in terms of cost.

As described above, the fin 112 of the present invention has an effect of suppressing a decrease in ventilation due to the dew condensation water bridge and improving the heat exchange rate of the heat exchanger even when no dew condensation occurs, as compared with the conventional hydrophilic treatment by forming a hydrophilic coat.

Embodiment 1 of the present invention is not limited to the fin 112, and may be, for example, a cooling water pipe for a radiator made of copper, or a member constituting a water cooling jacket for cooling a power device, and in any case, the same effect as that of the fin 112 is exhibited. In addition, the carbon-containing hydrated oxide film 112B also has an effect of improving the corrosion resistance of the member.

Furthermore, the heat exchanger including members such as the fin 112 has the same effect as that of the fin 112.

In addition, it is apparent that an air conditioner and a refrigerator provided with the heat exchanger including members such as the fin 112 also have the same effect as that of the fin 112, and as a result, such air conditioner and the refrigerator have an effect of reducing power consumption.

The present invention is not limited to the aforementioned embodiment, and various modifications can be made within the scope of the appended claims. Other embodiments obtainable by suitably combining technical means disclosed in different embodiments of the present invention are also included in the technical scope of the present invention. Furthermore, the technical means disclosed in the embodiments can be combined to form a new technical feature.

INDUSTRIAL APPLICABILITY

The present invention can be used for the heat exchanger member requiring suppression of the decrease in ventilation due to the dew condensation water bridge.

REFERENCE SIGNS LIST

100 . . . indoor unit of air conditioner

112 . . . fin

112B . . . carbon-containing hydrated oxide film (metal oxide film)

112C . . . fine concave-convex portions

300 . . . bath

400 . . . electric circuit

The invention claimed is:

1. A heat exchanger member made of metal, comprising a metal oxide film, on a surface of the metal, in which concave-convex portions are provided and crystalline carbon is contained, wherein an average distance between apexes of the convex portions is 20 nm or more and 120 nm or less, an average value of heights of apexes of the convex portions adjacent to each other is 10 nm or more and 250 nm or less, and at least a portion of a surface of the metal oxide film is a hydrated oxide.

2. The heat exchanger member according to claim 1, wherein a content ratio of the crystalline carbon contained in a range of 3 nm to 5 nm from the surface of the metal oxide film is 3 at % or more and 40 at % or less.

3. The heat exchanger member according to claim 1, wherein the metal oxide film has a thickness of 100 nm or more and 300 nm or less.

4. A heat exchanger comprising a heat exchange fin including the heat exchanger member according to claim 1.

5. An indoor unit for an air conditioner, comprising the heat exchanger according to claim 4.

6. An outdoor unit for an air conditioner, comprising the heat exchanger according to claim 4.

7. A refrigerator comprising the heat exchanger according to claim 4.

* * * * *